US010726649B1

(12) United States Patent
Gorski

(10) Patent No.: US 10,726,649 B1
(45) Date of Patent: Jul. 28, 2020

(54) SYSTEM AND METHOD FOR PRE-AUTHENTICATING MOBILE DEVICE PRIOR TO PERFORMING VEHICLE FUNCTION

(71) Applicant: Ford Global Technologies, LLC, Dearborn, MI (US)

(72) Inventor: Ryan Joseph Gorski, Grosse Pointe Farms, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/272,950

(22) Filed: Feb. 11, 2019

(51) Int. Cl.
*G07C 9/00* (2020.01)
*E05B 81/78* (2014.01)
*E05B 81/76* (2014.01)

(52) U.S. Cl.
CPC ..... *G07C 9/00309* (2013.01); *E05B 81/77* (2013.01); *E05B 81/78* (2013.01); *G07C 2009/00357* (2013.01); *G07C 2209/63* (2013.01)

(58) Field of Classification Search
CPC ..... G07C 9/00309; E05B 81/77; E05B 81/78
USPC ..... 340/5.61
See application file for complete search history.

(56) References Cited

U.S. PATENT DOCUMENTS 8,706,350 B2 4/2014 Talty et al.
9,241,235 B2 1/2016 Santavicca
9,424,698 B2 8/2016 Yasui et al.
9,679,430 B2 6/2017 O'Brien et al.
9,858,735 B2 1/2018 Spahl et al.
2007/0200672 A1* 8/2007 McBride ..... B60R 25/245 340/5.72
2013/0342379 A1* 12/2013 Bauman ..... G01S 13/0209 342/21
2014/0165675 A1* 6/2014 Morita ..... E05B 77/44 70/256
2014/0253288 A1* 9/2014 O'Brien ..... G07C 9/00309 340/5.61
2014/0320260 A1* 10/2014 Van Wiemeersch ..... G06K 7/10069 340/5.61

(Continued)

OTHER PUBLICATIONS

Hella, *Keyless Go*, retrieved from https://www.hella.com/techworld/uk/Technical/Car-electronics-and-electrics/Keyless-Go-3195/ on Nov. 13, 2018, 5 pages.

*Primary Examiner* — Kerri L McNally
(74) *Attorney, Agent, or Firm* — Frank Lollo; Eversheds Sutherland (US) LLP

(57) ABSTRACT

A vehicle includes doors, antennas, and processors. Each of the doors include an interface. The processors: (1) define, via the antennas, first zones and a second zone encompassing the first zones and surrounding the vehicle, each of the first zones associated with each of the doors; (2) in response to a mobile device entering the second zone, determine whether the mobile device is authenticated; (3) in response to the mobile device being authenticated, determine whether a user-interaction with the interface of one of the doors has occurred and determine, via the antennas, whether the mobile device is positioned in one of the first zones corresponding to said door; and (4) in response to detecting that the user-interaction has occurred and that the mobile device is positioned in said first zone, cause said door to unlock.

17 Claims, 3 Drawing Sheets

(56) References Cited

U.S. PATENT DOCUMENTS

| | | | | |
|---|---|---|---|---|
| 2015/0061830 | A1* | 3/2015 | Yamane | G07C 9/00111 340/5.64 |
| 2018/0103414 | A1 | 4/2018 | Golsch | |
| 2018/0151009 | A1* | 5/2018 | Kim | B60R 25/245 |
| 2018/0220429 | A1 | 8/2018 | Hazebrouck et al. | |
| 2019/0230471 | A1* | 7/2019 | Golgiri | G01S 5/00 |

* cited by examiner

SYSTEM AND METHOD FOR PRE-AUTHENTICATING MOBILE DEVICE PRIOR TO PERFORMING VEHICLE FUNCTION

TECHNICAL FIELD

The present disclosure generally relates to a system and method for pre-authenticating a mobile device prior to performing a vehicle function and, more specifically, a system and method for pre-authenticating a mobile device based on the location thereof prior to performing a vehicle function.

BACKGROUND

Vehicles are capable of performing various automated functions for user convenience. These automated functions are generally performed once a user is authenticated by said vehicles. One of such functions may be a passive entry feature that allow users to access a vehicle without using a key. Generally, in lieu of the key, a vehicle communicates with a mobile device (e.g., a smart phone or a key fob) to determine whether the mobile device is authenticated for use in passive entry, and based on the determination, the vehicle unlocks its doors. Conventional vehicles perform the authentication process once a vehicle door handle is actuated. Therefore, an inevitable delay is created between a time point in which a vehicle door is actuated to a subsequent time point in which the vehicle door is unlocked. Therefore, there is a need to minimize the delay to improve user convenience.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example vehicle and method are disclosed herein. An example vehicle includes doors, antennas, and processors. Each of the doors include an interface. The processors: (1) define, via the antennas, first zones and a second zone encompassing the first zones and surrounding the vehicle, each of the first zones associated with each of the doors; (2) in response to a mobile device entering the second zone, determine whether the mobile device is authenticated; (3) in response to the mobile device being authenticated, determine whether a user-interaction with the interface of one of the doors has occurred and determine, via the antennas, whether the mobile device is positioned in one of the first zones corresponding to said door; and (4) in response to detecting that the user-interaction has occurred and that the mobile device is positioned in said first zone, cause said door to unlock.

An example method includes: (1) defining, via antennas, first zones and a second zone encompassing the first zones and surrounding a vehicle, the vehicle comprising the antennas and doors, each of the doors comprising an interface, and each of the first zones associated with each of vehicle door; (2) responsive to a mobile device entering the second zone, determining whether the mobile device is authenticated; (3) in response to the mobile device being authenticated, determining whether a user-interaction with the interface of one of the doors has occurred and determining, via the antennas, whether the mobile device is positioned in one of the first zones corresponding to said door; and (4) in response to detecting that the user-interaction has occurred and that the mobile device is positioned in said first zone, causing said door to unlock.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
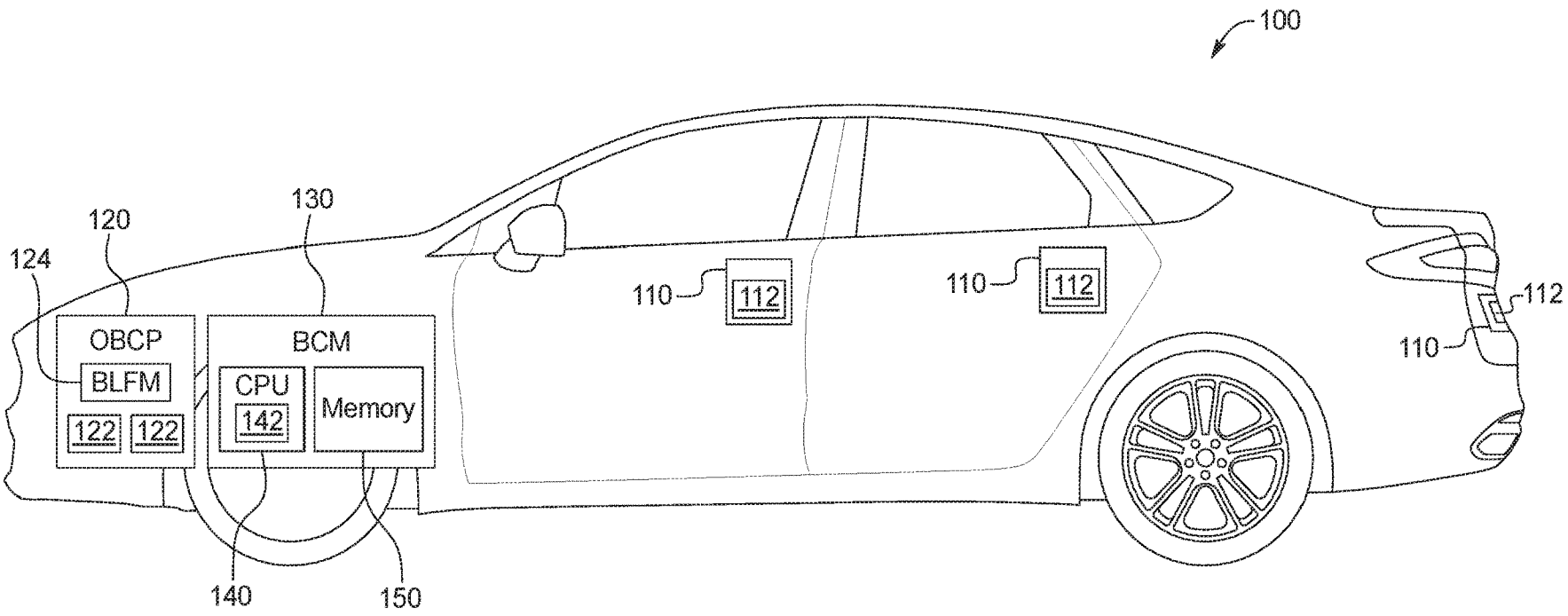
FIG. 1 illustrates a vehicle in accordance with this disclosure.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Modern vehicles perform various automated functions to minimize interaction between the user and the vehicle to improve user convenience. These automated functions are generally performed once a user is authenticated by said vehicles. One of such functions may be a Passive Entry and Passive Start (PEPS) feature which allow users to access a vehicle without the use of a physical key and automatically activate the ignition thereof. These vehicles perform an authentication process to determine whether a user is authenticated and provide said automated functions based on the determination. Generally, the authentication process is performed subsequent to an interaction between the user and an interface (e.g., that of the vehicle or a user's mobile device). For example, vehicles with conventional PEPS systems perform the authentication process once a vehicle door handle is actuated. Therefore, an inevitable delay is created between a time point in which a vehicle door is actuated to a subsequent time point in which the vehicle door is unlocked. Therefore, there is a need to minimize the delay to improve user convenience.

FIG. 1 illustrates a vehicle in accordance with this disclosure. FIG. 1 illustrates a vehicle 100 in accordance with this disclosure. The vehicle 100 may be a standard gasoline powered vehicle, a hybrid vehicle, an electric vehicle, a fuel cell vehicle, and/or any other mobility implement type of vehicle. The vehicle 100 includes parts related to mobility, such as a powertrain with an engine, a transmission, a suspension, a driveshaft, and/or wheels, etc. The vehicle 100 may be a semi-autonomous vehicle (e.g., some routine motive functions, such as parking, are controlled by the vehicle 100), or an autonomous vehicle (e.g., motive functions are controlled by the vehicle 100 without direct driver input). In this illustrated example, the vehicle 100 includes vehicle door access devices 110, an on-board communications platform 120, and a body control module (BCM) 130. The vehicle door access devices 110, the on-board communications platform 120, and the BCM 130 may be communicatively coupled to each other via at least one bus and/or a wireless communication interface.

Each of the vehicle door access devices 110 is disposed on a vehicle door and a vehicle truck. In some examples, the vehicle door access device 110 is disposed on a vehicle panel, window, and/or other user accessible location. A vehicle door access device 110 grants access for a user to enter a vehicle cabin. The vehicle door access device 110 may include at least one processor (not illustrated), at least one memory (not illustrated), and at least one antenna 112. The vehicle door access device 110 may be instructed to lock and unlock the vehicle door. The vehicle door access device 110 may include an interface (e.g., a switch, a handle, a knob, a touchscreen, etc.) that may be actuated to request permission to unlock or open the vehicle door on which the vehicle door access device 110 is disposed. The vehicle door access device 110 may unlock the vehicle door when the BCM 130 grants access.

The on-board communications platform 120 includes at least one processor (not illustrated), at least one memory (not illustrated), and a plurality of antennas 122. The on-board communications platform 120 may establish wireless communication with one or more wireless devices, such as a mobile device, an external server, a wireless node, etc. In some examples, the on-board communications platform 120 may utilize one or more antennas of the vehicle door access devices 110 to establish wireless communications. In the illustrated example, the on-board communications platform 120 is structured to include a Bluetooth Low Energy module (BLEM) 122. The BLEM 122 may establish a wireless connection with one or more BLE compatible devices. The BLEM 122 implements the Bluetooth and/or BLE protocols as set forth in the Bluetooth Specification 4.2 (and subsequent revisions) maintained by the Bluetooth Special Interest Group. It should be appreciated that the on-board communications platform 120 may include other modules for establishing wireless communications via different protocols (e.g., Global System for Mobile Communications (GSM), Universal Mobile Telecommunications System (UMTS), Long Term Evolution (LTE), Code Division Multiple Access (CDMA), WiMAX (IEEE 802.16m); Near Field Communication (NFC); local area wireless network (including IEEE 802.11 a/b/g/n/ac or others), dedicated short range communication (DSRC), and Wireless Gigabit (IEEE 802.11ad), etc.).

The BCM 130 controls various subsystems of the vehicle 100. For example, the BCM 130 may communicate with various electronic control units (ECUs) to control vehicle door locks, communication systems, power windows, power locks, an immobilizer system, and/or power mirrors, etc. The BCM 130 includes circuits to, for example, drive relays (e.g., to control wiper fluid, etc.), drive brushed direct current (DC) motors (e.g., to control power seats, power locks, power windows, wipers, etc.), drive stepper motors, and/or drive LEDs, etc. The BCM 130 may further communicate with a vehicle battery (not illustrated) to determine the state-of-charge thereof. The BCM 130 includes a processor or controller 140 and memory 150. In the illustrated example, the BCM 130 is structured to include a pre-authentication controller 142. Alternatively, in some examples, the pre-authentication controller 142 may be incorporated into another ECU with its own processor and memory. The processor or controller 134 may be any suitable processing device or set of processing devices such as, but not limited to: a microprocessor, a microcontroller-based platform, a suitable integrated circuit, one or more field programmable gate arrays (FPGAs), and/or one or more application-specific integrated circuits (ASICs). The memory 150 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, non-volatile solid-state memory, etc.), unalterable memory (e.g., EPROMs), read-only memory, and/or high-capacity storage devices (e.g., hard drives, solid state drives, etc). In some examples, the memory 150 includes multiple kinds of memory, particularly volatile memory and non-volatile memory.

The memory 150 is computer readable media on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 150, the computer readable medium, and/or within the processor 134 during execution of the instructions.

The terms "non-transitory computer-readable medium" and "tangible computer-readable medium" should be understood to include a single medium or multiple media, such as a centralized or distributed database, and/or associated caches and servers that store one or more sets of instructions. The terms "non-transitory computer-readable medium" and "tangible computer-readable medium" also include any tangible medium that is capable of storing, encoding or carrying a set of instructions for execution by a processor or that cause a system to perform any one or more of the methods or operations disclosed herein. As used herein, the term "tangible computer readable medium" is expressly defined to include any type of computer readable storage device and/or storage disk and to exclude propagating signals.

Figure 2:
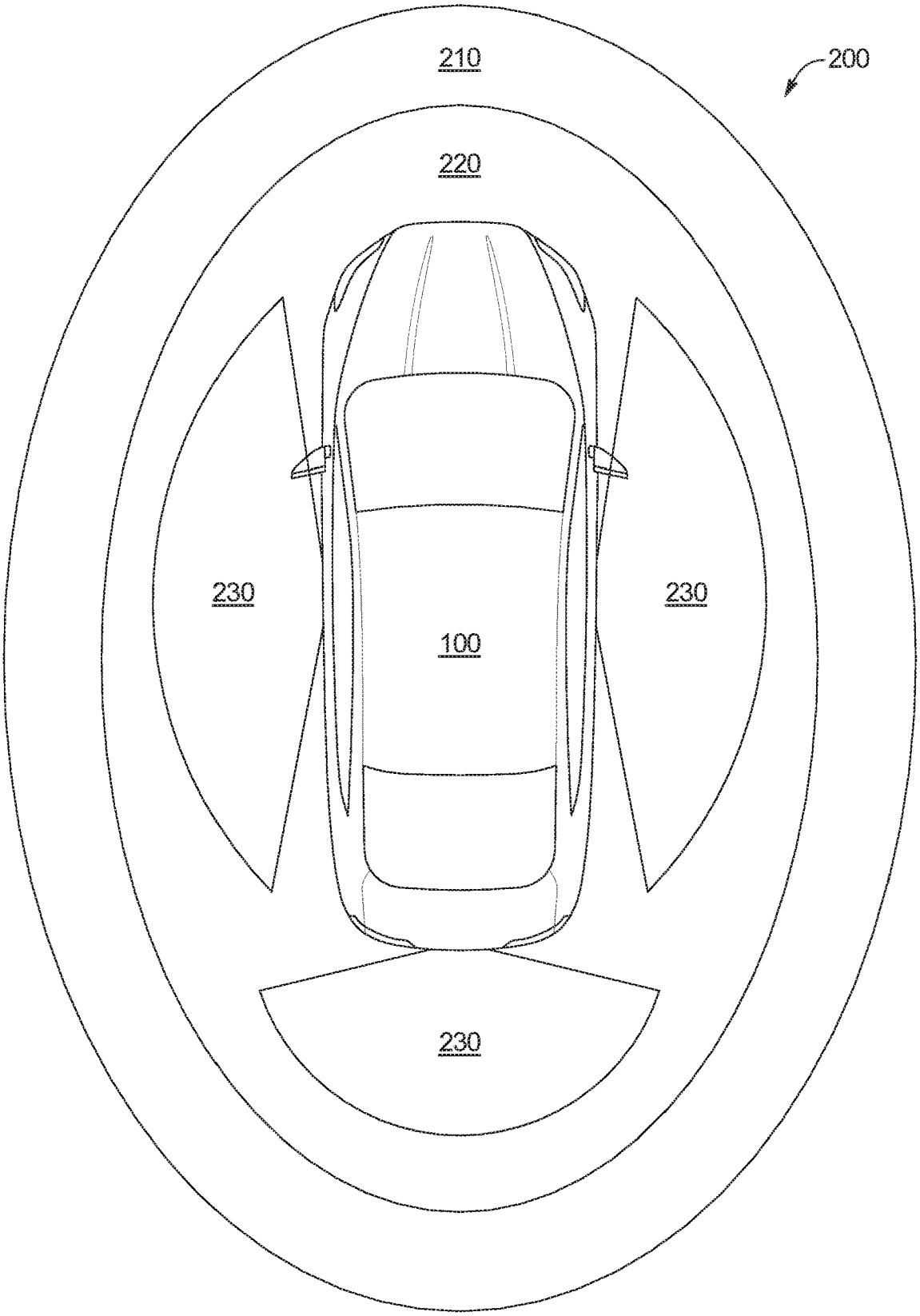
FIG. 2 illustrates a plan view of the vehicle of FIG. 1 and a plurality of zones established by the same.

FIG. 2 illustrates a plan view 200 of the vehicle of FIG. 1 and a plurality of zones established by the same. Operations of the pre-authentication controller 142 will be described in detail herein.

The pre-authentication controller 142 performs a pre-authentication process based on the position of a mobile device with respect to a plurality of zones. As described herein, a mobile device may refer to a cell phone, a smart phone, a key fob, a tablet, or any portable device capable of establishing wireless communication with the vehicle 100. The pre-authentication process includes, among other steps, authenticating the mobile device prior to performing a particular vehicle action.

In the illustrated example, the plurality zones include the localization zone 210, the approach zone 220, and the plurality of sub-zones 230. The pre-authentication controller 142 operates with the on-board communications platform 120 to define a plurality of zones surrounding the vehicle. The localization zone 210 wholly includes the approach zone 220, and the approach zone 220 wholly includes the plurality of sub-zones 230. The approach zone 220 may include an area that does not overlap with any of the plurality of sub-zones 230. In alternative examples, the localization zone 210 may include an area that does not overlap with the approach zone 220. Herein, a sub-zone is defined as any volume of space within a 3 dimensional space or any area within a 2 dimensional space where a location of the mobile device can be determined within a quantifiable measure of confidence in relation to the location of the vehicle 100. In the illustrated example, each of the plurality of sub-zones 230 is corresponds to a particular side of the vehicle. For example, the plurality of sub-zones 230 may include a driver side sub-zone, a passenger side sub-zone, and a rear side sub-zone. While the illustrated example in FIG. 2 includes three zones, it should be appreciated that additional sub-zones 230 may be defined for the vehicle 100.

In some examples, the pre-authentication controller 142 requests the on-board communications platform 120 to perform a search for the mobile device. When the mobile device is positioned outside of the plurality of zones, the on-board communications platform 120 activates less than all of the antennas 122. When the mobile device enters the localization zone 210, the on-board communications platform 120 activates all of the antennas 122 and localize the mobile device by using said antennas 122.

When the mobile device enters the approach zone 220, the on-board communications platform 120 determines the position of the mobile device with respect to the plurality of sub-zones 230. For example, for each instance in which the antennas 122 has detect that the mobile device has entered or exited one of the plurality of sub-zones, the on-board communications platform 120 generates pre-authentication data including a message indicative of said instance. By using the pre-authentication data, the pre-authentication controller 142 may determine the current location of the mobile device with respect to the vehicle 100. In some examples, the pre-authentication controller 142 may store a history of pre-authentication data generated from a point in time in which the mobile device has entered the approach zone 220 to a subsequent point in time (e.g., for a predetermine amount of time or when the mobile device exits the approach zone 220). In some examples, the pre-authentication controller 142 may use prior locations of the mobile device to estimate the current direction and/or trajectory in which the mobile device is moving. In some examples, the pre-authentication controller 142 may operate such that any previously recorded pre-authentication data is overwritten by the latest pre-authentication data.

When the mobile device enters one of the plurality of sub-zones 230, the pre-authentication controller 142 determines whether the mobile device is authenticated. For example, the pre-authentication controller 142 may cause the on-board communications platform 120 to communicate with the mobile device by using an encryption scheme to determine whether the mobile device is authenticated. The authentication process may be dependent on a basis that the mobile device has been previously registered with the vehicle 100 and previously authorized for use in association with the particular vehicle action.

If the mobile device is an authenticated device, the pre-authentication controller 142 determines whether a trigger event has occurred. The trigger event may be distinguished by two categories: an active trigger and a passive trigger.

The active trigger refers to an occurrence of an event in which an interaction between a user and an interface (e.g., a vehicle door handle, the mobile device) has occurred. For example, the active trigger may refer to an event in which a user has actuated a vehicle door access device 110. An example scenario in which a vehicle action occurs based on the active trigger is described. In this scenario, a vehicle action refers to an instance in which a vehicle door is unlocked. To determine whether a vehicle door should be unlocked, the pre-authentication controller 142 determines whether one of the plurality of vehicle door access device 110 has been actuated. If one of the plurality of vehicle door access device 110 has been actuated, the pre-authentication controller uses the pre-authentication data to further determine whether the mobile device is positioned in one of the plurality of sub-zone 230 that corresponds to a side of the vehicle including said vehicle door access device 110. If the mobile device is positioned in said one of the plurality of sub-zone 230, the pre-authentication controller causes the vehicle door corresponding to said vehicle door access device 110 to automatically unlock. If the mobile device is not positioned in said one of the plurality of sub-zone 230 when said one of the plurality of vehicle door access device 110 has been actuated, the pre-authentication controller 142 ignores the request to unlock said one of the plurality of vehicle door access device 110.

The passive trigger refers to an occurrence of an event excluding any interaction between a user and an interface. For example, the passive trigger may refer to an event in which the mobile device stays within one of the plurality of sub-zones 230 for a predetermined amount of time. An example scenario in which a vehicle action occurs based on the passive trigger is described. In this scenario, the vehicle 100 is assumed to be a pick-up truck including a retractable running board. The running board provides a physical platform for a user to place his/her foot thereon for facilitating access to a vehicle cabin. The retractable running board may be positioned between a first position in which the retractable running board is presented for use and a second position in which the retractable running board is withdrawn. In this scenario, a vehicle action refers to an instance in which the retractable running board moves from the second position to the first position. The retractable running board may be positioned on each of the left side and the right side of the vehicle 100. To determine whether the retractable running board should be positioned to the first position, the pre-authentication controller 142 uses the pre-authentication data to determine whether the mobile device is positioned in one of the plurality of sub-zones 230 corresponding to a side of the vehicle 100 including the retractable running board. If the pre-authentication controller 142 determines that the mobile device is positioned within said sub-zone for a predetermined amount of time, the pre-authentication controller 142 causes the retractable running board corresponding to said sub-zone 230 to move to the first position.

It should be appreciated that the above example scenarios should be construed as non-limiting embodiments. It should be appreciated that the vehicle actions, the passive triggers, and the active triggers described in the above examples may be different actions and triggers and/or different combination of actions and triggers. In some examples, a passive trigger may be an event in which the mobile device reaches a threshold distance from the vehicle 100 while the mobile device is positioned within one of the plurality of sub-zones 230. In some examples, a vehicle action may be automatically loading vehicle settings based on a user preference that has been previously set. For example, vehicle settings may include, but are not limited to, settings for adjusting seat position, mirror placement, radio station, etc. In some examples, a vehicle action may be automatically unlocking and opening a trunk door.

It should be appreciated that the pre-authentication process, as discussed above, may be performed with respect to multiple mobile device. For example, the pre-authentication controller 142 may operate with the on-board communications platform 120 to determine the location of each of a plurality of mobile device with respect to the plurality of zones.

In some examples, if a trigger (i.e., the passive trigger or the active trigger) is not satisfied subsequent to a point in time in which the mobile device has entered the approach zone 220 and within a predetermined amount of time, the pre-authentication controller 142 performs the authentication process (i.e., the step of authenticating the mobile device) only when the trigger occurs first. If the mobile device is successfully authenticated from said authentication process, the pre-authentication controller 142 allows a vehicle action to occur.

In some examples, if the mobile device does not enter a sub-zone 230 subsequent to entering the approach zone 220 and within a predetermined amount of time, the pre-authentication controller 142 performs the authentication process (i.e., the step of authenticating the mobile device) only when the trigger occurs first. If the mobile device is successfully authenticated from said authentication process, the pre-authentication controller 142 allows a vehicle action to occur.

In some examples, the pre-authentication process, as discussed above, may be performed only when an approach detection mode has been enabled. When the vehicle 100 operates under the approach detection mode, the pre-authentication controller 142 causes the vehicle 100 to notify the user that the vehicle 100 has detected the user's intent for approaching the vehicle 100. For example, the pre-authentication controller 142 may activate at least one vehicle exterior lighting (not illustrated) to signal that the vehicle 100 has detected the user's intent for approaching the vehicle 100.

In some examples, to conserve power, the pre-authentication controller 142 performs the pre-authentication process, as discussed above, only when a state-of-charge of the vehicle battery satisfies a threshold level.

In some examples, the pre-authentication process, as discussed above, may occur only when a user has previously provided an input (e.g., via the mobile device or a user interface disposed in the vehicle 100) for enabling the pre-authentication process.

Figure 3:
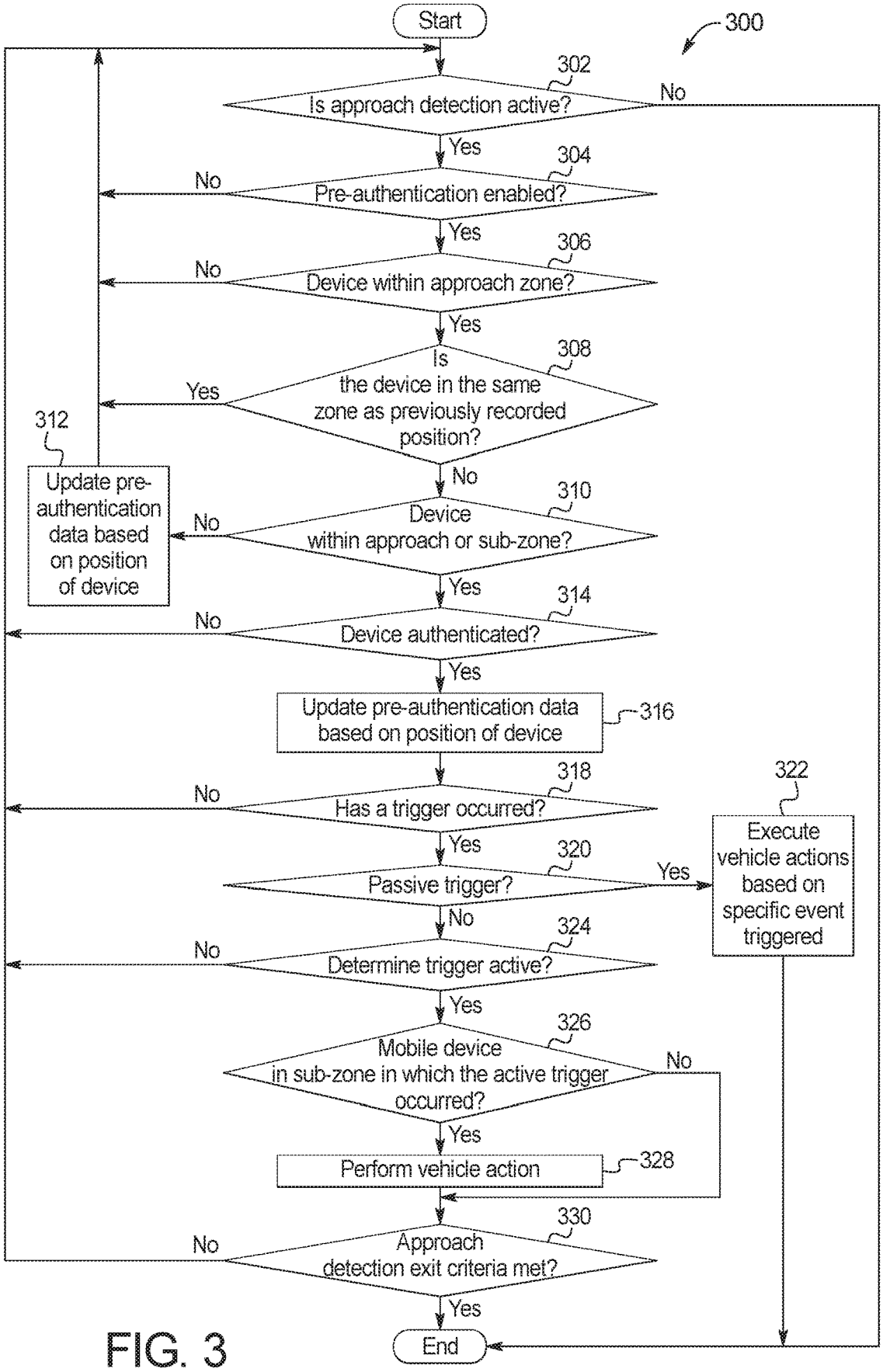
FIG. 3 illustrates a flowchart of a method for pre-authenticating a mobile device prior to performing a vehicle function.

FIG. 3 illustrates a flowchart 300 of a method for pre-authenticating a mobile device prior to performing a vehicle function, which may be implemented by the vehicle of FIG. 1.

At block 302, the pre-authentication controller 142 determines whether the vehicle 100 is operating in an approach detection mode. If so, the method continues to block 304. Otherwise, the method terminates.

At block 304, the pre-authentication controller 142 determines whether the pre-authentication process is enabled. If so, the method continues to block 306. Otherwise, the method returns to block 302.

At block 306, the pre-authentication controller 142 determines whether a mobile device is within the approach zone 220. As illustrated in FIG. 2, the approach zone 220 includes the plurality of sub-zones 230 an area that does not overlap with the plurality of sub-zones 230. If the mobile device enters the approach zone 220, the method continues to block 308. Otherwise, the method returns to block 302.

At block 308, the pre-authentication controller 142 determines whether the mobile device is within the same zone as a previously recorded position. If so, the method returns to block 302. Otherwise, the method continues to block 310.

At block 310, the pre-authentication controller 142 determines whether the mobile device is within the approach zone 220 or the plurality of sub-zones 230. If so, the method continues to block 314. Otherwise, the method continues to block 312.

At block 312, the pre-authentication controller 142 updates the pre-authentication data based on the position of the mobile device.

At block 314, the pre-authentication controller 142 determines whether the mobile device is authenticated. If so, the method continues to block 316. Otherwise, the method returns to block 302.

At block 316, the pre-authentication controller 142 updates the pre-authentication data based on the position of the mobile device.

At block 318, the pre-authentication controller 142 determines whether a trigger for a vehicle action has occurred. If so, the method continues to block 320. Otherwise, the method returns to block 302.

At block 320, the pre-authentication controller 142 determines whether the trigger is a passive trigger. If so, the method continues to block 322. Otherwise, the method continues to block 324.

At block 322, the pre-authentication controller 142 performs the vehicle action associated with the passive trigger.

At block 324, the pre-authentication controller 142 determines that the trigger is an active trigger.

At block 326, the pre-authentication controller 142 determines whether the mobile device is within a sub-zone 230 in which the active trigger has occurred. If so, the method continues to block 328. Otherwise, the method continues to block 330.

At block 328, the pre-authentication controller 142 performs a vehicle action associated with the active trigger.

At block 330, the pre-authentication controller 142 determines whether an approach detection exit criteria has been met. The approach detection exit criteria may be defined by an event in which: (1) the ignition of the vehicle 100 is turned on; (2) the user has entered the vehicle 100; or (3) the user has provided an input (e.g., via the mobile device or a vehicle user interface) to disable the pre-authentication process. If so, the method terminates. Otherwise, the method returns to block 302. It should be appreciated that the approach detection exit criteria may be defined by other events not listed in this disclosure.

The flowchart 300 of FIG. 3 is representative of machine readable instructions stored in memory (such as the memory 150 of FIG. 1) that comprise one or more programs that, when executed by a processor (such as the processor 140 of FIG. 1), cause the vehicle 100 to implement the example pre-authentication controller 142 of FIG. 1. Further, although the example program(s) is/are described with reference to the flowchart illustrated in FIG. 3, many other methods of implementing the example pre-authentication controller 142 may alternatively be used. For example, the order of execution of the blocks may be changed, and/or some of the blocks described may be changed, eliminated, or combined.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". As used here, the terms "module" and "unit" refer to hardware with circuitry to provide communication, control and/or monitoring capabilities, often in conjunction with sensors. "Modules" and "units" may also include firmware that executes on the circuitry. The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A vehicle comprising:

doors, each of the doors comprising an interface;

a power source;

antennas; and processors configured to:

define, via the antennas, first zones and a second zone encompassing the first zones and surrounding the vehicle, each of the first zones associated with each of the doors;

responsive to a mobile device entering the second zone, determine whether the mobile device is authenticated;

responsive to the mobile device entering the second zone, determine a state of charge of the power source; and responsive to state of charge being greater than a threshold, determine whether the mobile device is authenticated responsive to the mobile device being authenticated:

determine whether a user-interaction with the interface of one of the doors has occurred; and determine, via the antennas, whether the mobile device is positioned in one of the first zones corresponding to said door; and responsive to detecting that the user-interaction has occurred and that the mobile device is positioned in said first zone, cause said door to unlock.

2. The vehicle of claim 1, wherein the interface is a vehicle door handle, and wherein the user-interaction is defined by an event in which a user has actuated the vehicle door handle.

3. The vehicle of claim 1, wherein the processors are further configured to:

responsive to the mobile device entering the second zone, initiate a timer for a predetermined period; and responsive to failing to detect the user-interaction with the interface of any one of the doors within the predetermined period, authenticate the mobile device after the user-interaction has occurred.

4. The vehicle of claim 1, wherein the processors are further configured to:

responsive to the mobile device entering the second zone, initiate a timer for a predetermined period; and responsive to failing to detect, via the antennas, the mobile device within said first zone within the predetermined period, authenticate the mobile device after the user-interaction has occurred.

5. The vehicle of claim 1, wherein the processors are further configured to:

define, via one of the antennas, a third zone encompassing the first zones and the second zone;

responsive to detecting any mobile device within the third zone, cause all of the antennas to be activated; and responsive to detection no mobile device within the third zone, cause only the one of the antennas to be activated.

6. The vehicle of claim 1, wherein the processors are further configured to:

for each instance in which the mobile device has entered or exited any one of the first zones and the second zone, generate a pre-authentication data indicating said instance; and use the pre-authentication data to determine whether the mobile device is within said first zone.

7. The vehicle of claim 1, wherein the doors comprise at least one door configured to provide access to a vehicle cabin and a trunk door configured to provide access to a vehicle storage compartment.

8. The vehicle of claim 1, wherein each of the first zones are separate from each other.

9. A method comprising:

defining, via antennas, first zones and a second zone encompassing the first zones and surrounding a vehicle, the vehicle comprising the antennas and doors, each of the doors comprising an interface, and each of the first zones associated with each of vehicle door;

defining, via one of the antennas, a third zone encompassing the first zones and the second zone;

responsive to detecting any mobile device within the third zone, causing all of the antennas to be activated;

responsive to detection no mobile device within the third zone, causing only the one of the antennas to be activated;

responsive to a mobile device entering the second zone, determining whether the mobile device is authenticated;

responsive to the mobile device being authenticated:

determining whether a user-interaction with the interface of one of the doors has occurred; and determining, via the antennas, whether the mobile device is positioned in one of the first zones corresponding to said door; and responsive to detecting that the user-interaction has occurred and that the mobile device is positioned in said first zone, causing said door to unlock.

10. The method of claim 9, wherein the interface is a vehicle door handle, and wherein the user-interaction is defined by an event in which a user has actuated the vehicle door handle.

11. The method of claim 9, further comprising:

responsive to the mobile device entering the second zone, initiating a timer for a predetermined period; and responsive to failing detect the user-interaction with the interface of any one of the doors within the predetermined period, authenticating the mobile device after the user-interaction has occurred.

12. The method of claim 9, further comprising:

responsive to the mobile device entering the second zone, initiating a timer for a predetermined period; and responsive to failing to detect, via the antennas, the mobile device within said first zone within the predetermined period, authenticating the mobile device after the user-interaction has occurred.

13. The method of claim 9, further comprising:

responsive to the mobile device entering the second zone, determining a state of charge of a power source of the vehicle;

responsive to state of charge being greater than a threshold, determining whether the mobile device is authenticated; and responsive to state of charge being less than the threshold, authenticating the mobile device after the user-interaction has occurred.

14. The method of claim 9, further comprising:

for each instance in which the mobile device has entered or exited any one of the first zones and the second zone, generating a pre-authentication data indicating said instance; and using the pre-authentication data to determine whether the mobile device is within said first zone.

15. The method of claim 9, wherein the doors comprise at least one door configured to provide access to a vehicle cabin and a trunk door configured to provide access to a vehicle storage compartment.

16. The method of claim 9, wherein each of the first zones are separate from each other.

17. A vehicle comprising:

doors, each of the doors comprising an interface;

antennas; and processors configured to:

define, via the antennas, first zones and a second zone encompassing the first zones and surrounding the vehicle, each of the first zones associated with each of the doors;

for each instance in which the mobile device has entered or exited any one of the first zones and the second zone, generate a pre-authentication data indicating said instance;

use the pre-authentication data to determine whether the mobile device is within said first zone;

responsive to a mobile device entering the second zone, determine whether the mobile device is authenticated;

responsive to the mobile device being authenticated:

determine whether a user-interaction with the interface of one of the doors has occurred; and determine, via the antennas, whether the mobile device is positioned in one of the first zones corresponding to said door; and responsive to detecting that the user-interaction has occurred and that the mobile device is positioned in said first zone, cause said door to unlock.

* * * * *